United States Patent [19]

Potoczek et al.

[11] 4,168,059

[45] Sep. 18, 1979

[54] COMPENSATING MEANS FOR ADJUSTING THE RESETTING OF PAPER GATE DEVICE

[75] Inventors: Richard A. Potoczek, Danbury; Henry Bleggi, Fairfield, both of Conn.

[73] Assignee: Pitney-Bowes, Inc., Stamford, Conn.

[21] Appl. No.: 864,206

[22] Filed: Dec. 27, 1977

[51] Int. Cl.[2] ..... B65H 9/04

[52] U.S. Cl. ..... 271/245; 355/3 SH

[58] Field of Search ..... 355/3 R, 3 SH, 3 TR, 355/14; 271/245, 246

[56] References Cited

U.S. PATENT DOCUMENTS 3,603,680 9/1971 Barton ..... 355/3 R 3,804,507 4/1974 Koch et al. ..... 271/246 X

*Primary Examiner*—Fred L. Braun

*Attorney, Agent, or Firm*—Martin D. Wittstein; William D. Soltow, Jr.; Albert W. Scribner

[57] ABSTRACT

A compensating or correcting arrangement for electronically adjusting the resetting of a paper gate device in a xerographic machine; such arrangement eliminates the problem which occurs, under certain conditions, when the trailing edge of a copy sheet is clipped by the projections or fingers controlled by the solenoid of the paper gate device. The arrangement includes a time delay circuit for delaying the application of the reset signal to the solenoid thereby extending its activation period.

11 Claims, 5 Drawing Figures

FIG.1
PRIOR ART
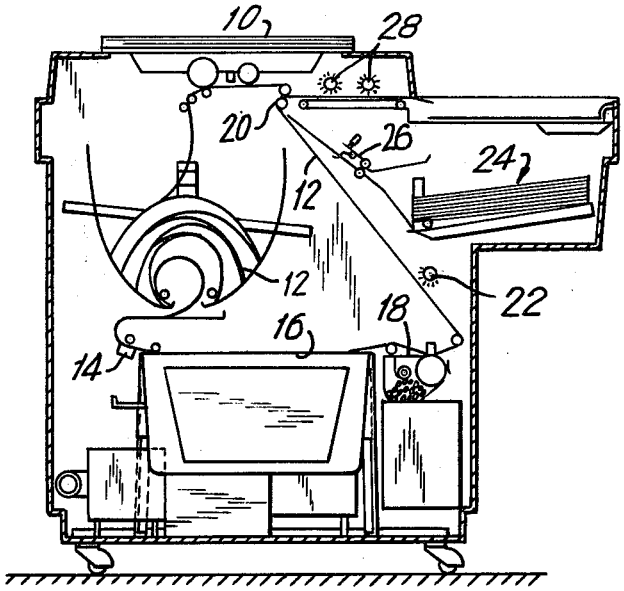
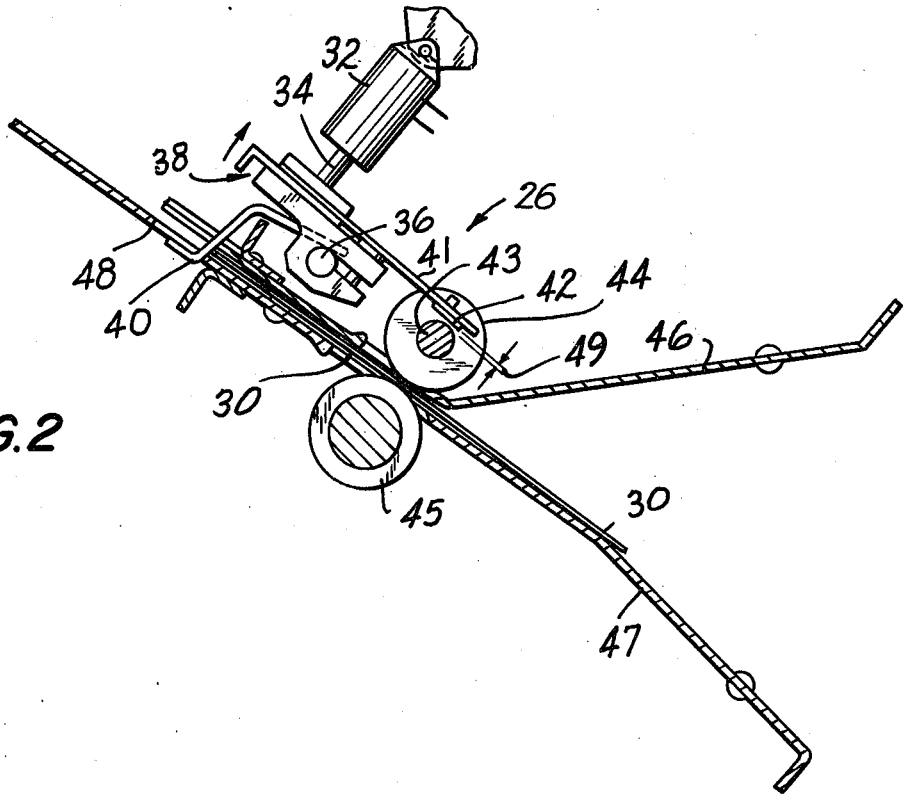
FIG.2

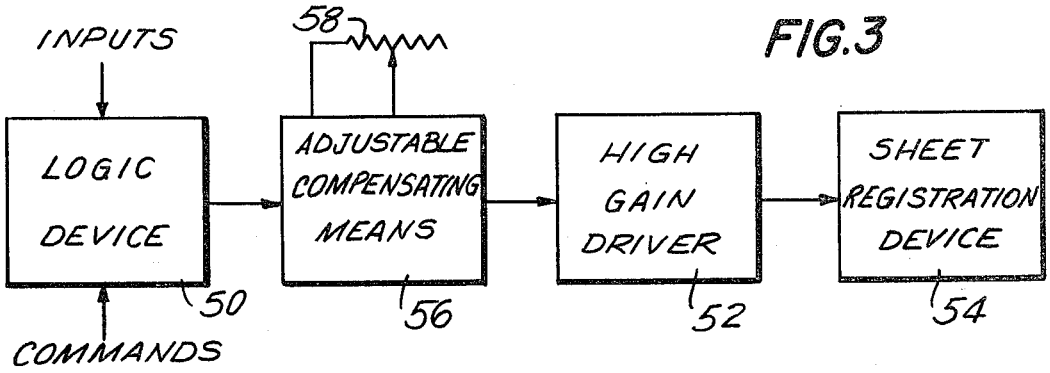
FIG.3
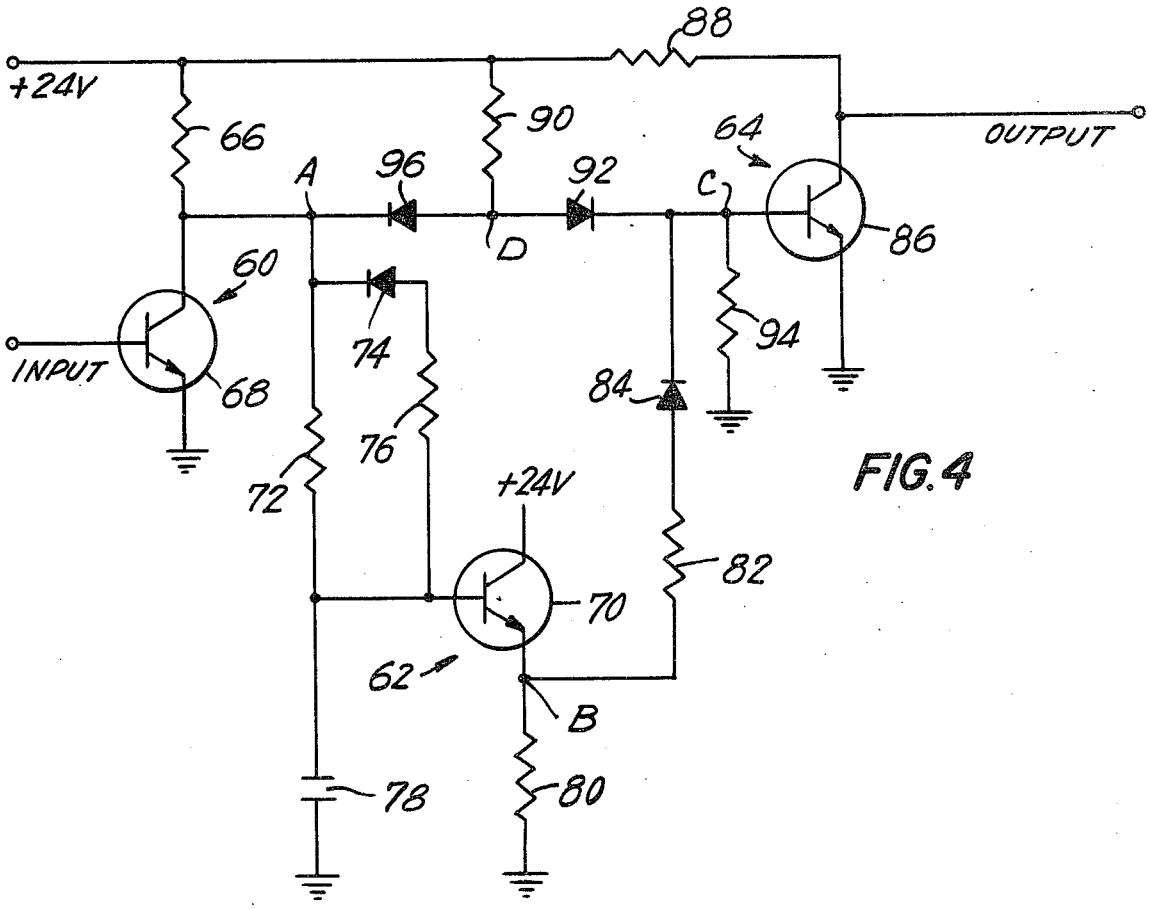
FIG.4
FIG.5
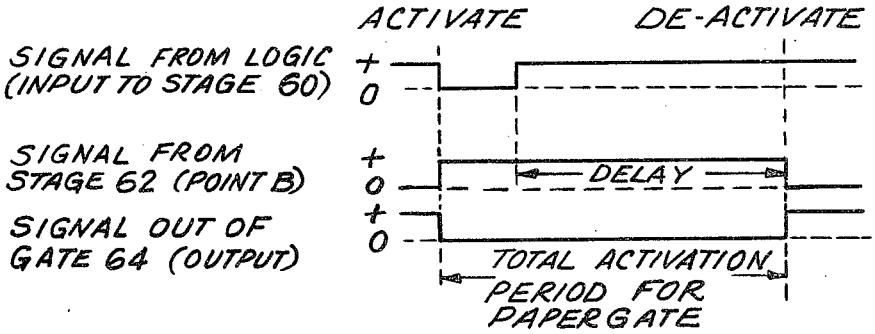

COMPENSATING MEANS FOR ADJUSTING THE RESETTING OF PAPER GATE DEVICE

BACKGROUND OF THE INVENTION

The present invention relates to sheet registration devices and, more particularly, to such devices and to similar arrangements as found in the context of printing or copying machines.

For an appreciation of xerographic apparatuses and processes, particularly with respect to sheet feeding and registration devices associated therewith, reference may be had to the following U.S. Pat. Nos. 3,339,917; 3,902,715; 3,957,366 and 4,023,792.

It is an important requirement in the functioning of xerographic and similar copying machines that the copy paper to which the xerographic image is to be transferred be precisely and carefully registered with such image as formed on a photoconductive matrix, whereby the desired end of having the copy reproduce the original exactly may be effectuated. For this purpose, a copy paper gate or gating device is effective to control the registration process. Thus, a sheet of copy paper is normally fed out of a feeder tray and up to the paper gate. The paper gate controls the insertion of a projection into the path of a given copy sheet, so as to stop that sheet. Then when the projection is removed, the sheet will advance in timed relationship to the rest of the machine according to the logic system employed. The operation is continuous such that the aforesaid projection is successively reinserted into the same path to stop the next sheet.

Just before the photoconductive matrix reaches a transfer roller or similar device, the copy sheet being advanced is carried beyond the paper gate device and is subsequently fed between the powder image on the conductive matrix and the transfer roller. As a result, the image is transferred onto the copy paper and is registered as precisely as possible. For example, the point on the copy paper at which an image begins or ends is within one-sixteenth of an inch from the corresponding point on the matrix image. However, attainment of this precise registration is affected by the speed of the reproduction process. Consequently, when it is desired, for example, to produce copies in relatively short periods such that the speed of the copy paper moving within the machine is of the order of ten inches per second, the time period or "window" that is allotted to the registration process is extremely limited. Accordingly, the time allowed for the paper gate solenoid to perform its functions so that the projection or "finger" will be able to react and to reset is severely restricted.

As a result of the aforenoted restrictions, it has been found that a vexing problem arises in the effort to produce exact registration, particularly when fourteen inch copy paper is involved in the process. What has occurred is that the trailing edge of the paper is clipped such that velocity change then takes place, resulting in undesirable effects.

It will, of course, be appreciated that it is impractical, if not impossible, to build all of the components in a copy machine to a virtually perfect degree of accuracy. Instead, conventional tolerances are accepted and some sort of adjustable means is provided for the purpose of exactly synchronizing the copy paper movement with the movement of the photoconductive matrix. In a conventional machine to be described, the adjustment mechanism includes a gap which is provided between the feed roller for the copy paper and a spring clamp member which engages a shaft of such feed roller. When the paper gate assembly is actuated, the feed roller is brought into pinching engagement with a continuously driven roller, thereby to advance a given copy sheet. Normally what is done is that this gap, which is precisely located between a plastic button provided on the spring clamp and the feed roller shaft, is adjusted to have a value from 0.020 inches to 0.040 inches (0.030 inches nominal).

However useful the slight adjustment of the aforenoted gap is in accomplishing the required synchronization, it turns out that substantial adjustment of this gap for the purpose of curing the vexing problem of trail edge clipping of fourteen inch paper is ineffective. This is because any tampering with the tolerances set on this gap inevitably results in improper pressure being applied to different copy papers that may be utilized in the machine. For example, different weights and grades of paper are commonly utilized and if this gap is not kept within the strict tolerance limits that have been specified, proper pressure will not be afforded for driving each kind of copy paper, with all that that means in terms of misregistration of the copy paper with the photoconductive matrix.

Accordingly, it is the primary object of the present invention to solve the aforenoted problem of trail edge clipping of fourteen inch copy paper as experienced in a xerographic copying process.

Another object is to compensate and correct for the variations in mechanical settings and in the different reluctance properties of paper gate solenoids, which factors tend to create varying time lags, from machine to machine, between electrical activation and the actual mechanical movement of the paper gate solenoid.

Another object of the invention is to provide for electronic adjustment in the delay that is provided in the resetting of a paper gate device.

SUMMARY OF THE INVENTION

The above and other objects of the invention are fulfilled by a primary feature thereof according to which a compensating means is provided for adjustably resetting the sheet registration device. More particularly, the compensating means includes a time delay means for delaying the application of the reset signal to the paper gate device, while permitting the normal activation signal to energize such device.

A more specific feature resides in the fact that the time delay provided effectively extends the "on time" of the paper gate solenoid thereby to correct for all the inherent variations within tolerance limits, such as those previously noted, which cause or provoke the described problem of trail edge clipping.

It is a further specific feature of the present invention that a time delay on the order of 55 milliseconds is provided in a delay circuit so as to correct for that problem.

Other and further objects, advantages and features of the present invention will be understood by reference to the following specification in conjunction with the annexed drawing, wherein like parts have been given like numbers.

BRIEF DESCRIPTION OF THE DRAWING

FIG. 1 is a diagrammatic view of a well known xerographic machine, in which some of the principal parts utilized in the xerographic process are illustrated;

FIG. 2 is an enlarged view of the paper gate device, including a solenoid, functioning to provide registration of copy paper with a photoconductive matrix or sheet.

FIG. 3 is a block diagram of the arrangement in which the compensating means of the present invention is incorporated for the purpose of adjusting the resetting of the sheet registration device;

FIG. 4 is a schematic diagram of the aforesaid compensating means;

FIG. 5 is a pulse diagram illustrating the timed pulses that are applied to or received from the compensating means.

DESCRIPTION OF PREFERRED EMBODIMENT

Before proceeding with a description of a preferred embodiment of the present invention, reference will be made first to FIG. 1 of the drawing in which a diagrammatic showing is presented in side elevation of the principal parts of the equipment utilized in a well-known xerographic copying process. It will be understood that an original document is positioned under the cover 10 of the machine and, after a PRINT button or the like has been pressed to activate a main switch, a section of photoconductive matrix 12 is transported out of its hopper and through the machine, passing a charger unit 14. The charged section of the photoconductive matrix then passes over a projection area 16 to which a reflected image is projected via a lens and mirrors, not seen, onto the charged section. As is also well understood, exposure to the light reflected from the non-image area of the original dissipates the charge on the photoconductive matrix section leaving the image areas charged. The continuous transportation of the photoconductive matrix carries it through a powder unit 18, at which point charged particles of toner are attracted to the negatively charged image, thereby causing a visual image to be obtained.

Before arriving at a transfer roller 20, the photoconductive matrix passes lamps 22 which partially neutralize the charge on the photoconductive matrix so that the image can be more easily transferred onto the copy paper. During the time that the photoconductive matrix is transported toward the transfer roller 20, a sheet of copy paper is fed out of the feeder 24 and up to the paper gate 26. Immediately before the photoconductive matrix reaches transfer roller 20, the copy paper is carried past the paper gate 26. Thereafter, as the copy paper is fed between the powder image photoconductive matrix and transfer roller 20, the image is transferred onto the copy paper.

Other steps that remain to be performed on the copy are such as fusing of the image by lamps 28, and subsequent cleaning of the residual charge and of the remaining powder from the matrix. However, the important point to note is that the registration of the copy paper with the photoconductive matrix is a key factor in producing accurate copies. Accordingly, the present invention successfully insures accuracy in the registration process by compensating for those variations responsible for the trailing edge clipping problem, already alluded to, which is a source of misregistration difficulties.

Referring now to FIG. 2 of the drawing, there is illustrated in some detail the sheet registration device, comprising a solenoid actuated paper gate device 26 which controls the feeding and registration of a copy sheet 30 to the transfer roller 20 seen in FIG. 1, whereby the copy sheet is properly registered with the advancing photoconductive matrix 12. A solenoid 32 is activated by appropriate activation signals such that its plunger 34 causes the clockwise rotation of a shaft 36 through movement of a lever arm not seen. As a result, a paper gate assembly 38 mounted to the shaft 36 is rotated so as to lift a projection, in the form of a finger 40, out of the path of the copy sheet 30. Thus, upon suitable rotation of the assembly 38 the copy sheet of paper 30 is free to be advanced. Such advancement occurs because, at the same time that the assembly is rotated, a leaf spring 41, forming part of the assembly 38, causes a plastic button 42 at its one end to engage with a feed roll shaft 43 thereby to move roller 44 so as to pinch the copy sheet 30 between itself and a continuously driven roller 45. Also seen in FIG. 2 are a conventional upper paper guide plate 46 and a lower plate 47.

It will be understood that when the solenoid has not been activated, the arrangement is precisely as depicted in FIG. 2; that is to say, in the normal position the projection 40 extends through a suitable aperture 48 in the lower guide plate and thus acts to block the passage of the copy sheet 30.

It should be especially noted that a suitable gap 49 is provided between the plastic button 42 mounted on the leaf spring 41. The normal setting for this gap is between 0.020 inches and 0.040 inches or, in other words, it has a nominal value of 0.030 inches. The latter value is selected in order that proper pressure will be applied at the nip of the rollers 44 and 45 to the copy paper 30 regardless of what particular kind or type of paper, within limits, is employed. Thus, a variety of papers of different weights and textures, such as clear sheets and so forth, may serve as the copy paper.

Slight adjustment, however, is permitted and is even required in order that the copy paper will be synchronized with the photoconductive matrix 12. In other words, since parts cannot be built to exact dimensions, there must be some tolerances allowed; hence there will not always be perfect synchronization for every machine with respect to the feeding of the paper and of the photoconductive matrix. Therefore, adjustment in the gap 49 can be made so as to bring about exact synchronization. To do this, simple clamp screws are provided at the front and rear sides of the leaf spring 41 so that the desired gap can be effectuated.

As has been indicated previously, despite the fact that the gap 49 has been set to obtain substantially perfect synchronization, yet when fourteen inch paper is being used the aforenoted vexing problem of trail edge clipping of copy sheet 30 occurs.

It might be thought that perhaps a simple adjustment or variation of this gap 49 would solve the trail edge clipping problem. However, such is not the case inasmuch as this would involve a sacrifice of the driving pressure; that is, the driving pressure would necessarily be reduced, with all that that entails: the copy paper would then be poorly fed and misregistration would result. Tests that have been performed have demonstrated that changing the gap 49 over a wide range will indeed substantially eliminate the trail edge clipping problem but, as just noted, the problems created are of as great or greater consequence to proper operation.

Moreover, it has been found from these tests that trail edge clipping is eliminated when the gap is selected to have a value such that approximately a 55 millisecond delay is produced between the end of an activating electrical signal that is applied to the solenoid and the actual start of mechanical dropping out of such solenoid. In general, as the gap is increased, such time lag likewise increases; also, the total time of the actual movement of the solenoid from the position of full-in (activated) to full-out (inactivated) also increases as the gap is increased.

In contrast to the technique of manually adjusting the gap 49, the present invention enables elimination of the aforedescribed vexing problem but without introducing any undesirable consequences. Most importantly, the driving pressure applied by the rollers to the copy paper can be maintained so that the copy paper is properly fed and will register correctly.

The present invention provides an electronic arrangement as depicted in the block diagram of FIG. 3. The block designated 50 represents the logic device, or "board", for the entire machine, and can involve simply mechanical switching, or can comprise integrated circuits or a microprocessor. The purpose of the logic device is to coordinate all of the procedures and operations of the machine. This is accomplished by sensing inputs and commands as indicated, and then sending signals at the proper time to the various processing stations for each of the functions that are to be performed. In the normal situation of the transmission of an activation signal to a sheet registration device, the logic device 50 applies such activation signal directly to a high gain driver 52 which operates to power up the low power logic signal to a level sufficient to provide energization of the sheet registration device symbolized by the block 54. Driver 52 also includes an inverter device which functions to provide, when appropriate, an inversion of the signals applied to its input. The sheet registration device 54 corresponds substantially with the paper gate device 26 as illustrated in FIG. 1, such device comprising a means for gating the leading edge of a particular copy sheet.

The compensation or correction that has been recognized by the present invention as required is implemented by a compensation means 56 interposed between the logic device 50 and the high gain driver 52. By the judicious application of such means any mechanical setting or magnetic reluctance variations that tend to create varying time lags, from machine to machine, can be completely adjusted for. Thus, the stricture can be observed on the close clearance provided for the gap between the plastic button and the feed roller shaft; that is, approximately 0.030 inches is maintained, whereby proper driving pressure is applicable to the copy sheet. Yet, a cumulative time delay can be completely corrected for by dint of the delay means 58 included as part of the compensating means 56. As will be made clear hereinafter, although such delay means can be made to be variable over a reasonable range so as to permit fine adjustment for a particular machine, a fixed value can be used since it has been found that this is also satisfactory.

Referring now to FIG. 4, the detailed schematic diagram illustrates the elements involved in the compensating means 56. It will be especially noted that the pulses involved with the circuit of FIG. 4 are shown in FIG. 5. The compensating means 56 includes three basic stages or sub-circuits; namely, an inverter stage 60, a time delay stage 62, and a gate or gating stage 64. All of these stages or sub-circuits are supplied with a 24 volt DC supply, the stage 60 being supplied by way of the collector resistor 66 connected to an NPN transistor 68 in a common emitter or inverter mode. Stage 62 comprises another NPN transistor 70 in an emitter follower mode, which likewise has its collector connected to the 24 volt DC supply. The input to this transistor includes a biasing network, connected to the output A of stage 60 and to the base of transistor 70. The input biasing network includes a resistor 72, which is connected in shunt with a diode 74 and a resistor 76. Further connection is made from the base of transistor 70 to ground by way of capacitor 78; an emitter output resistor 80 is connected to ground. The output B is connected by way of the resistor 82 and diode 84 to the input C of stage 64. This stage includes a transistor 86, the emitter of which is taken to ground, and the collector of which is connected by way of resistor 88 to the 24 volt supply. An input biasing network connected to the base of transistor 86 includes a resistor 90, diode 92; a further resistor 94 has its upper end connected to the base of transistor 86 and its other end is taken to ground. A further diode 96 is connected between the collector of previous stage 60, that is, the collector of transistor 68, and the input circuit to transistor 86.

Considering the operation of the compensating circuit 56, that is, when the solenoid 42 is not being activated, then normally the input to stage 60 is high, that is, at approximately 0.6 volts, such that transistor 68 is turned ON. As a result, transistor 70 is turned OFF, because its base is then approximately at ground as a consequence of the output A, at the collector of transistor 68, being at ground. Due to the control exercised by the OR circuit, comprising resistor 90 and diodes 92, 96 and 84, it is so arranged that whichever anode of the diodes 92 and 84 is at higher potential will determine the state of transistor 86.

Now let it be assumed that an activation signal or energization signal (FIG. 5) is applied from the logic device 50 such that the input to the compensation circuit 56 drops to substantially zero, then transistor 68 will be turned OFF resulting in a high positive voltage at its collector (output A). As a result, diode 96 becomes reversed biased and the junction D of diodes 96 and 92 will tend to go high; however, it will only reach approximately 1.2 volts. In turn, since the base of transistor 86 becomes sufficiently biased positively, that transistor goes ON. Also, the rise in potential at point A results in the charging of capacitor 78 and, as a consequence, transistor 70 is turned ON such that the emitter thereof (output B) goes high and the anode of diode 84 goes to approximately 1.2 volts. However, at this time there is no additional effect because transistor 86 has already been turned ON.

Now, consider the effects when the solenoid activation signal from the logic device 50 terminates. Transistor 68 is again turned ON and its collector returns to ground with the result that point D returns to 0.6 volts. But, because of the fact that diode 84, with its anode at 1.2 volts, provides an alternative or OR function, transistor 86 will be momentarily kept in the ON state. However, because transistor 68 has turned ON, the base of transistor 70 will eventually become low enough to turn transistor 86 OFF. This happens because capacitor 78 is able to discharge along the discharge path including the resistor 76. Thus, the RC time constant of resistor 76 and capacitor 78 of this network controls the discharge time, which is selected to be approximately 60 milliseconds. Accordingly, when capacitor 78 has been fully discharged transistor 70 will revert to the OFF state with the effect of turning transistor 86 OFF such that the signal from the collector of the logic gate 64 then becomes positive (FIG. 5).

Instead of the electronic arrangement of FIG. 4 in which discrete elements have been utilized so as to take advantage of lower costs, an integrated circuit device, such as the well-known 555 timer, can be utilized; and the same internal logic as is evident from FIG. 4 can be implemented in such integrated circuit arrangement.

Although the critical resistor, that is, the discharge resistor 76, is shown in FIG. 4 as being a fixed resistor, such resistor can consist of, for example, a 50 K ohm potentiometer, or variable resistor, in series with a 1 K ohm fixed resistor, whereby any required fine adjustment can be attained for the particular resistor value needed. The reason a fixed resistor 76 has been illustrated in FIG. 4 is that it has been found that such a sufficiently large resistor can provide for most copying machines the required time period for extending the activation signal from the logic input.

In order to provide the man skilled in the art with a detailed set of specifications for practicing the electrical circuit in FIG. 4, the following listing is given of types and values of components involved:

| Resistors | | | Transistors | | |
|---|---|---|---|---|---|
| 66 | 5.1 | K ohm | 68 | 2N | 4400 |
| 72 | 100 | K ohm | 70 | | " |
| 76 | 12.1 | K ohm (±1%, ¼ w.) | 86 | | " |
| 80 | 22 | K ohm | | | |
| 82 | 10 | K ohm | | | |
| 88 | 22 | K ohm | | | |
| 90 | 22 | K ohm | | | |
| 94 | 100 | K ohm | | | |
| **Capacitors** | | | **Diodes** | | |
| 78 | 2.2 | μF (±10%, 50 v.) | 74 | IN | 4148 |
| | | | 84 | | |
| | | | 92 | | |
| | | | 96 | | |

A number of tests have been conducted in order to verify that an average time delay period would be satisfactory for a great number of machines. Preliminary data indicate that with the aforenoted fixed resistor 76 having a value of 12.1 K ohms (±1%, ¼w.), an average 62 millisecond delay was attained. One hundred machines were run to check whether the trail edge clipping phenomenon would be eliminated. Preliminary data indicate that all of the machines operated satisfactorily with this time delay such that the trail edge clipping problem was completely cured.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. In a copying or reproducing machine in which a photoconductive matrix is advanced along a path or pathway and copy paper is brought into registration with said matrix by operation of a sheet registration device, said device comprising a paper gate including a solenoid, and further in which said solenoid is activated by application of an activation signal and is de-activated by a reset signal corresponding to the termination of the activation signal, the improvement comprising:

a compensating means for electronically adjusting the resetting of said paper gate, including a time delay means for delaying the application of said reset signal to said solenoid.

2. The improvement as defined in claim 1, further comprising a logic device, connected to the input of said compensating means, for supplying said activation signal thereto; the output of said compensating means being connected to said sheet registration device; the time delay means being operable effectively to extend in time the application to said sheet registration device of said activation signal from said logic device.

3. The improvement as defined in claim 2, in which said compensating means includes three stages, the first, or input, stage being connected to the output of said logic device; the second stage functioning for time delay purposes; and the third stage constituting the output of said compensating means; the logic signals applied to the input having first and second voltage levels, and the output signals at said third stage having corresponding first and second voltage levels; said second stage acting to keep the output of the third stage at its second or activation voltage level for a predetermined delay period after the activation signal at the input has terminated, thereby to keep said sheet registration device in its activated state.

4. The improvement as defined in claim 3, in which said first voltage level for the logic signals applied to the input is a high positive voltage, the second level being zero voltage.

5. The improvement as defined in claim 3, in which an RC timing network is connected to the input of said second stage so as to keep said second stage in a predetermined state for said predetermined delay period.

6. The improvement as defined in claim 5, further in which said third stage includes a logical OR means operable such that the output signal remains at said second or activation voltage level so long as either said activation signal is present at said input, or said second stage is in said predetermined state.

7. The improvement as defined in claim 5, in which said means for providing the logical OR function includes a resistor and a pair of back-to-back diodes, said resistor being connected to the anodes of each of said diodes; the cathode of the first of the diodes being connected to the input of said third stage and the cathode of the other diode being connected to the output of the first stage; a further diode connected between the output of said second stage and the input of said third stage at a common junction point with respect to said first diode.

8. The improvement as defined in claim 3, in which each of said first, second and third stages has a first and second state, the first state corresponding with a condition in which no activation signal is present at the input to said compensating means, the second state normally corresponding with the presence of an activation signal.

9. The improvement as defined in claim 8, in which the first state corresponds with the ON state for the first and third stages, and with the OFF state for the second stage.

10. The improvement as defined in claim 9, in which said output signal remains at said second voltage level so long as either said activation signal is present such that said first stage is in its second state, or said second stage momentarily remains in its second state.

11. The improvement as defined in claim 10, in which said first and said third stages include a transistor connected in a common emitter mode, and said second stage includes a transistor connected in an emitter follower mode.

* * * * *